US009650576B2

(12) United States Patent
Akhras et al.

(10) Patent No.: US 9,650,576 B2
(45) Date of Patent: May 16, 2017

(54) STEAM CRACKING PROCESS AND SYSTEM WITH INTEGRAL VAPOR-LIQUID SEPARATION

(71) Applicant: Saudi Arabian Oil Company, Dhahran (SA)

(72) Inventors: Abdul Rahman Zafer Akhras, Dhahran (SA); Abdennour Bourane, Ras Tanura (SA); Raheel Shafi, Dhahran (SA); Ibrahim A. Abba, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 51 days.

(21) Appl. No.: 14/491,147

(22) Filed: Sep. 19, 2014

(65) Prior Publication Data

US 2015/0001130 A1 Jan. 1, 2015

Related U.S. Application Data

(63) Continuation-in-part of application No. PCT/US2013/033189, filed on Mar. 20, 2013.
(Continued)

(51) Int. Cl.
*C10G 9/36* (2006.01)
*C10G 9/16* (2006.01)

(52) U.S. Cl.
CPC *C10G 9/36* (2013.01); *C10G 9/16* (2013.01)

(58) Field of Classification Search
CPC ..... B01D 19/0068; B01D 19/0073; B01D 19/0057; B01D 19/0026; C07C 4/00;
(Continued)

(56) References Cited

U.S. PATENT DOCUMENTS 2,228,401 A 1/1941 Pressler
2,888,096 A 5/1959 Evans
(Continued)

FOREIGN PATENT DOCUMENTS

WO 2007047942 A2 4/2007
WO 2009088413 A1 7/2009

OTHER PUBLICATIONS

PCT/US2013/033189, International Search Report and Written Opinion dated Jul. 2, 2013, 11 pages.

*Primary Examiner* — Randy Boyer
*Assistant Examiner* — Juan Valencia
(74) *Attorney, Agent, or Firm* — Abelman, Frayne & Schwab

(57) ABSTRACT

An integrated vapor-liquid separation device is provided in conjunction with a steam pyrolysis cracking unit operation. In certain aspects, a feed is charged to the inlet of a convection portion of a steam pyrolysis unit where the feed is heated to conditions effective for steam cracking The convection section effluent is separated in a vapor-liquid separator and the separator vapor effluent is charged to the inlet steam cracking portion of the steam pyrolysis zone. The liquid effluent can be further processed, recycled within the system or a combination thereof. In additional aspects, a feed separated upstream of the convection portion of a steam pyrolysis unit using a flash vessel equipped with a vapor-liquid separator device described herein.

6 Claims, 7 Drawing Sheets

Related U.S. Application Data

(60) Provisional application No. 61/792,822, filed on Mar. 15, 2013, provisional application No. 61/613,332, filed on Mar. 20, 2012.

(58) Field of Classification Search
CPC .. C07C 4/02; C07C 4/08; C07C 4/025; C10G 9/36; C10G 9/34; C10G 9/40; C10G 9/16
See application file for complete search history.

(56) References Cited

U.S. PATENT DOCUMENTS 3,842,138 A 10/1974 Chahvekilan et al.
3,881,900 A 5/1975 Campbell et al.
3,944,481 A 3/1976 Wing et al.
4,002,556 A 1/1977 Satchell
4,065,379 A 12/1977 Soonawala et al.
4,070,168 A 1/1978 Beattie et al.
4,115,467 A 9/1978 Fowler
4,180,453 A 12/1979 Franck et al.
4,363,641 A 12/1982 Finn
4,539,023 A 9/1985 Boley
4,617,031 A 10/1986 Suh
4,778,494 A 10/1988 Patterson
4,798,665 A 1/1989 Humbach et al.
4,824,449 A 4/1989 Majoros
4,983,283 A 1/1991 Grey
5,192,421 A 3/1993 Audeh et al.
5,203,891 A 4/1993 Lema
5,258,117 A 11/1993 Kolstad et al.
5,415,776 A 5/1995 Homan
5,502,984 A 4/1996 Boehde et al.
5,643,470 A 7/1997 Amini
5,771,844 A 6/1998 Dietz
5,843,211 A 12/1998 Bielefeldt
5,906,728 A 5/1999 Iaccino et al.
6,190,533 B1 2/2001 Bradow et al.
6,210,561 B1 4/2001 Bradow et al.
6,303,842 B1 10/2001 Bridges et al.
6,409,808 B1 6/2002 Chamberlain et al.
6,458,191 B1 10/2002 Lingelem et al.
6,537,458 B1 3/2003 Polderman
6,632,351 B1 10/2003 Ngan et al.
6,673,135 B2 1/2004 West
6,773,492 B1 8/2004 West
6,821,322 B2 11/2004 Milia
6,991,114 B2 1/2006 Allen, II et al.
7,001,448 B1 2/2006 West
7,144,503 B2 12/2006 Oserød
7,193,123 B2 3/2007 Stell et al.
7,220,887 B2 5/2007 Stell et al.
7,244,871 B2 7/2007 Stell et al.
7,247,765 B2 7/2007 Stell et al.
7,278,543 B2 10/2007 Sagatun et al.
7,297,833 B2 11/2007 Beattie et al.
7,311,746 B2 12/2007 Stell et al.
7,312,371 B2 12/2007 Stell et al.
7,351,872 B2 4/2008 Stell et al.
7,358,413 B2 4/2008 Stell et al.
7,408,093 B2 8/2008 Stell et al.
7,413,669 B2 * 8/2008 Gonzalez ..... B04C 5/04 209/715
7,435,290 B2 10/2008 Lane et al.
7,481,871 B2 1/2009 Frye et al.
7,488,459 B2 2/2009 Stell et al.
7,718,049 B2 5/2010 Strack et al.
7,951,745 B2 5/2011 Zhou et al.
8,070,938 B2 12/2011 Stein et al.
8,071,833 B2 12/2011 Grootjans et al.
8,277,639 B2 10/2012 Buchanan et al.
2001/0042713 A1 11/2001 Conrad et al.
2004/0004022 A1 1/2004 Stell et al.
2004/0004027 A1 1/2004 Spicer et al.
2004/0004028 A1 1/2004 Stell et al.
2004/0054247 A1 3/2004 Powers et al.
2005/0209495 A1 9/2005 McCoy et al.
2005/0261530 A1 11/2005 Stell et al.
2005/0261538 A1 11/2005 Stell et al.
2006/0014994 A1 1/2006 Keusenkothen
2006/0094918 A1 5/2006 McCoy et al.
2007/0090018 A1 4/2007 Keusenkothen et al.
2007/0090020 A1 4/2007 Buchanan et al.
2007/0232846 A1 10/2007 Baumgartner et al.
2011/0042269 A1 2/2011 Kuechler et al.
2011/0174682 A1 7/2011 Iaccino
2011/0247500 A1 10/2011 Akhras et al.
2012/0125813 A1 5/2012 Bridges et al.

* cited by examiner

STEAM CRACKING PROCESS AND SYSTEM WITH INTEGRAL VAPOR-LIQUID SEPARATION

RELATED APPLICATIONS

This application is a continuation-in-part of P.C.T. Patent Application No. US 2013/033189 filed Mar. 20, 2013, which claims the benefit of priority of U.S. Provisional Patent Application Nos. 61/613,332 filed Mar. 20, 2012 and 61/792,822 filed Mar. 15, 2013, which are all incorporated by reference herein.

BACKGROUND OF THE INVENTION

Field of the Invention

The present invention relates to an improved steam cracking process and system.

Description of Related Art

Steam cracking processes typically involve two main sections, the convection and pyrolysis section. The convection section of the steam pyrolysis cracking zone is used to heat the feed to the required reaction temperatures, often called the cross-over temperature, prior to entering the steam pyrolysis cracking unit, wherein the pyrolysis cracking reaction occurs. Steam pyrolysis cracking reactions typically convert a relatively heavy hydrocarbon feedstock, which may include of a wide range of hydrocarbon components, into lighter, and more desirable, hydrocarbons, including but not limited to ethylene, propylene, butadiene, mixed butenes and pyrolysis gasoline.

Steam pyrolysis is a useful process that utilizes Le Chatelier's principle to create a more favorable reaction environment. The reactions that occur within a steam cracking process have more molecules on the product side of the equilibrium. Such reactions proceed to the more desirable product side when the reaction is performed under low pressure, as is stated by Le Chatelier's principle. The reaction normally occurs at atmospheric pressure; and running the cracking reaction at conditions lower then atmospheric pressures can be very uneconomical. Other conventional processes utilize a catalyst instead of steam to lower the activation energy and therefore create more desired products. However, in steam pyrolysis processes the addition of a low molecular weight diluent, steam is utilized. The addition of the low molecular weight steam to the cracking reaction lowers the partial pressure of the reaction system and creates more favorable reaction conditions and therefore increased desired products are formed.

Therefore it is an object of the present invention to provide improved steam cracking process and systems.

SUMMARY OF THE INVENTION

The system and process herein provides an integrated vapor-liquid separation device in conjunction with a steam pyrolysis cracking unit operation. In certain aspects, a feed is charged to the inlet of a convection portion of a steam pyrolysis unit where the feed is heated to conditions effective for steam cracking The convection section effluent is separated in a vapor-liquid separator and the separator vapor effluent is charged to the inlet steam cracking portion of the steam pyrolysis zone. The liquid effluent can be further processed, recycled within the system or a combination thereof In additional aspects, a feed separated upstream of the convection portion of a steam pyrolysis unit using a flash vessel equipped with a vapor-liquid separator device described herein.

Other aspects, embodiments, and advantages of the process of the present invention are discussed in detail below. Moreover, it is to be understood that both the foregoing information and the following detailed description are merely illustrative examples of various aspects and embodiments, and are intended to provide an overview or framework for understanding the nature and character of the claimed features and embodiments. The accompanying drawings are illustrative and are provided to further the understanding of the various aspects and embodiments of the process of the invention.

BRIEF DESCRIPTION OF THE DRAWINGS

The invention will be described in further detail below and with reference to the attached drawings where.

DEATILED DESCRIPTION OF THE INVENTION

Figure 1:
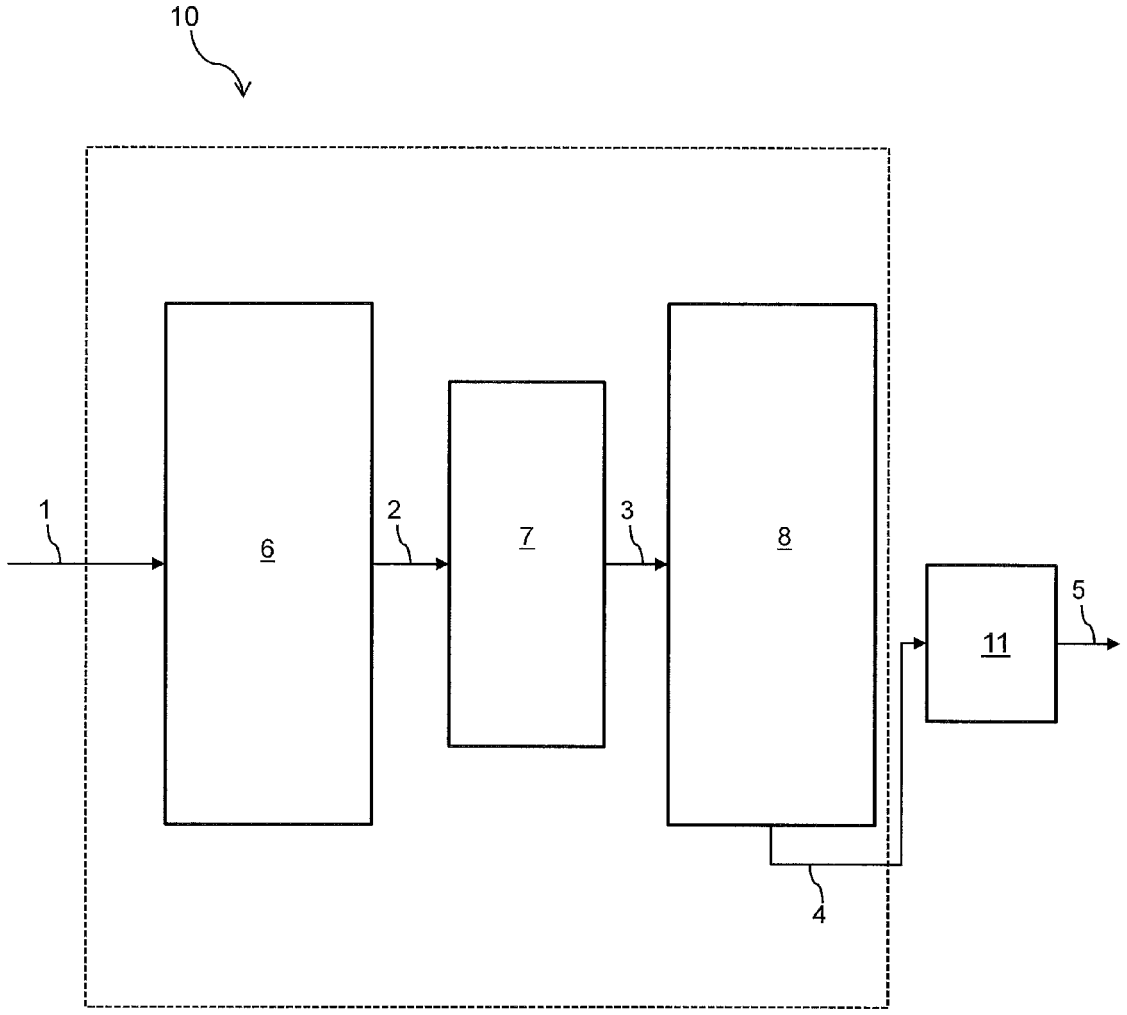
FIG. 1 is a process flow diagram of an embodiment of a steam cracking process with an integrated vapor-liquid separation zone between the convection and pyrolysis sections.

A process flow diagram for one embodiment of a steam cracking process with an integrated vapor-liquid separation is shown in FIG. 1. The integrated system generally includes a convection section and a steam pyrolysis section, with a vapor-liquid separation zone between the convection and pyrolysis sections.

Steam pyrolysis zone 10 generally comprises a convection section 6 and a pyrolysis section 8 that can operate based on steam pyrolysis unit operations known in the art, i.e., charging the thermal cracking feed to the convection section in the presence of steam. In addition, as shown in FIG. 1 a vapor-liquid separation section 7 is included between sections 6 and 8. Vapor-liquid separation section 7, through which the heated steam cracking feed from convection section 6 passes, can be a separation device based on physical or mechanical properties of vapors and liquids.

In certain embodiments, vapor-liquid separation devices are illustrated by, and with reference to, FIGS. 4A-4C and 5A-5C. A similar arrangement of a vapor-liquid separation device is also described in U.S. Patent Publication Number 2011/0247500 (which is incorporated by reference in its entirety herein) in which a device is provided to decelerate incoming flow. In the device constructed and arranged in the present systems and methods, vapor and liquid flow though in a cyclonic geometry whereby the device operates isothermally and at very low residence time (in certain embodiments less than 10 seconds), and with a relatively low pressure drop (in certain embodiments less than 0.5 bars). In general vapor is swirled in a circular pattern to create forces where heavier droplets and liquid are captured and channeled through to vertical section and a liquid outlet, while the vapors are sent for further processing in the steam pyrolysis section 9.

As shown in FIG. 1 steam pyrolysis zone 10 operates under parameters effective to crack feed 1, into the desired products. In certain embodiments, steam cracking is carried out using the following conditions: a temperature in the range of from 400° C. to 900° C. in the convection section and in the pyrolysis section; a steam-to-hydrocarbon ratio in the convection section in the range of from 0.3:1 to 2:1; and a residence time in the convection section and in the pyrolysis section in the range of from 0.05 seconds to 2 seconds.

Figure 2:
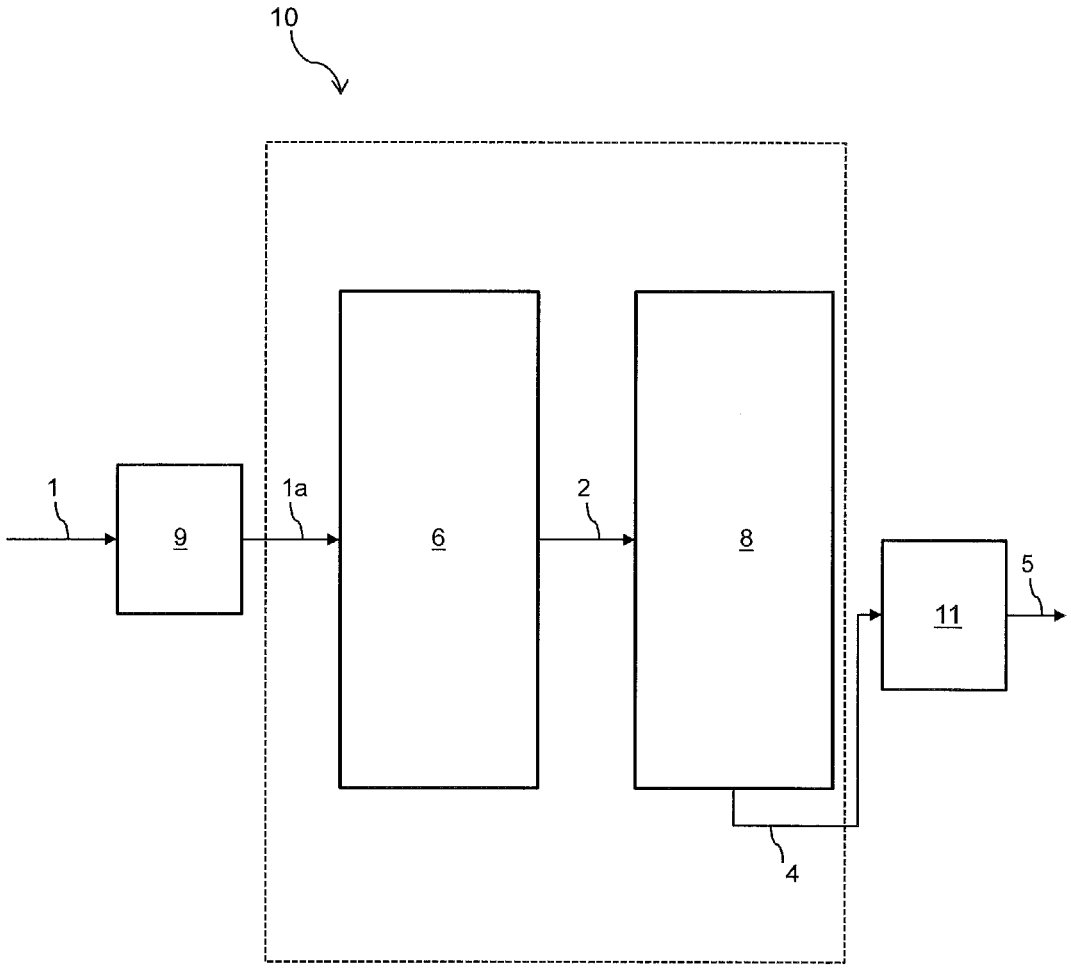
FIG. 2 is an embodiment of a steam cracking process with an integrated vapor-liquid separation zone upstream of the convection section and prior to the steam cracking process.
Figure 4A:
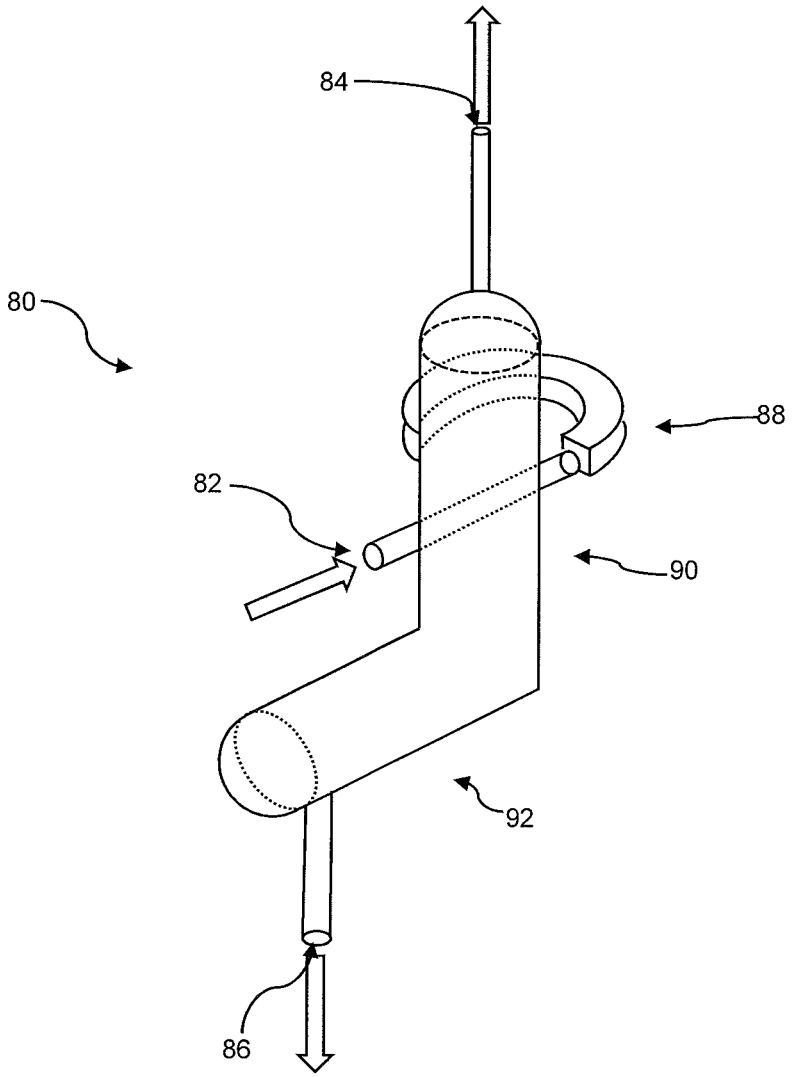
FIGS. 4A-4C are schematic illustrations in perspective, top and side views of a vapor-liquid separation device used in certain embodiments of a steam cracking unit operation and process described herein.
Figure 4B:
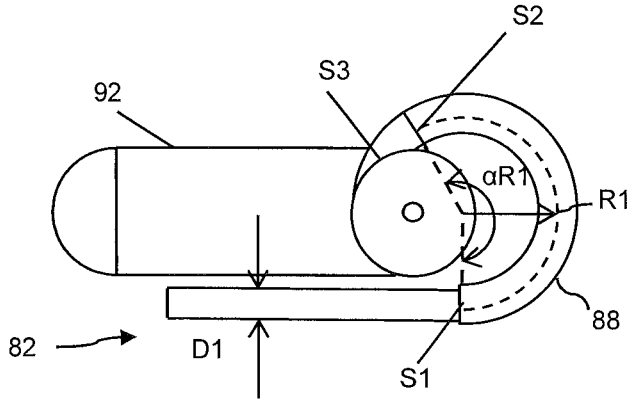
Figure 4C:
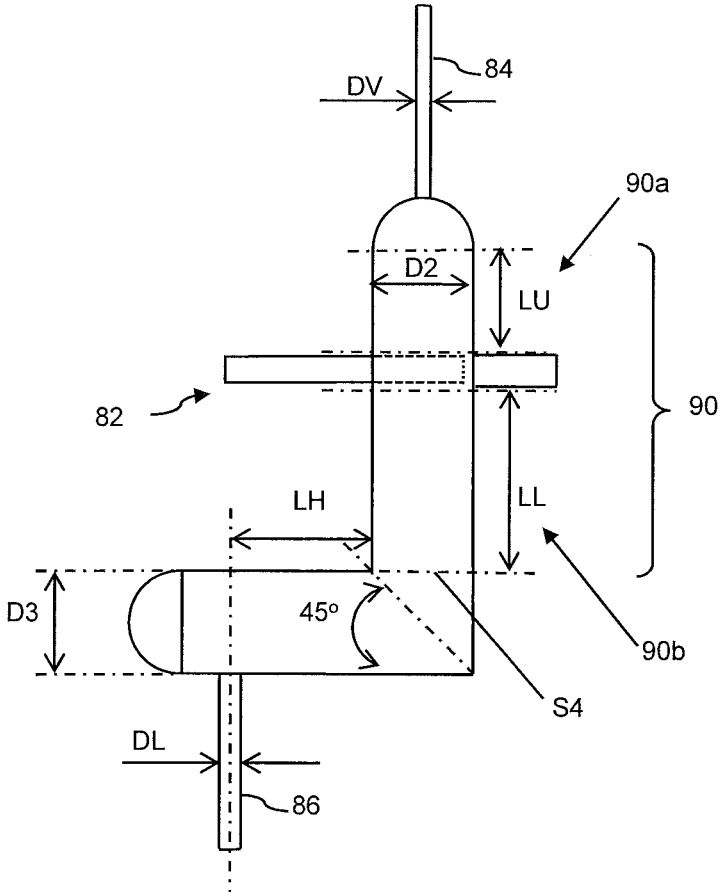

In another embodiment shown with respect to FIG. 2, a vapor-liquid separator 9 is included upstream of steam pyrolysis zone 10, through which feed 1 is charged. Vapor-liquid separator 9 shown in FIG. 2 can be a flash separation device including a separations device based on physical or mechanical separation of vapors and liquids, which is seen in FIGS. 4A-4C, or a combination including at least one of these types of devices (e.g. shown in FIGS. 5A-5C in which the inlet of a flash vessel includes a device based on physical or mechanical separation of vapors and liquids). The vapor phase effluent, stream 1*a*, of this separation section 9 is the feed to the steam pyrolysis zone 10, where in the convection section 6 the separated effluent is heating to temperatures effective to undergo steam cracking. The heated effluent is charged to the inlet of steam pyrolysis section 8, where steam can be added in effective quantities to crack the feed and produce a mixed product stream. The vaporization temperature and fluid velocity are varied to adjust the approximate temperature cutoff point, for instance in certain embodiments in the range of about 350° C. to about 600° C. for compatibility with residue blends and/or processing operations.

Figure 3:
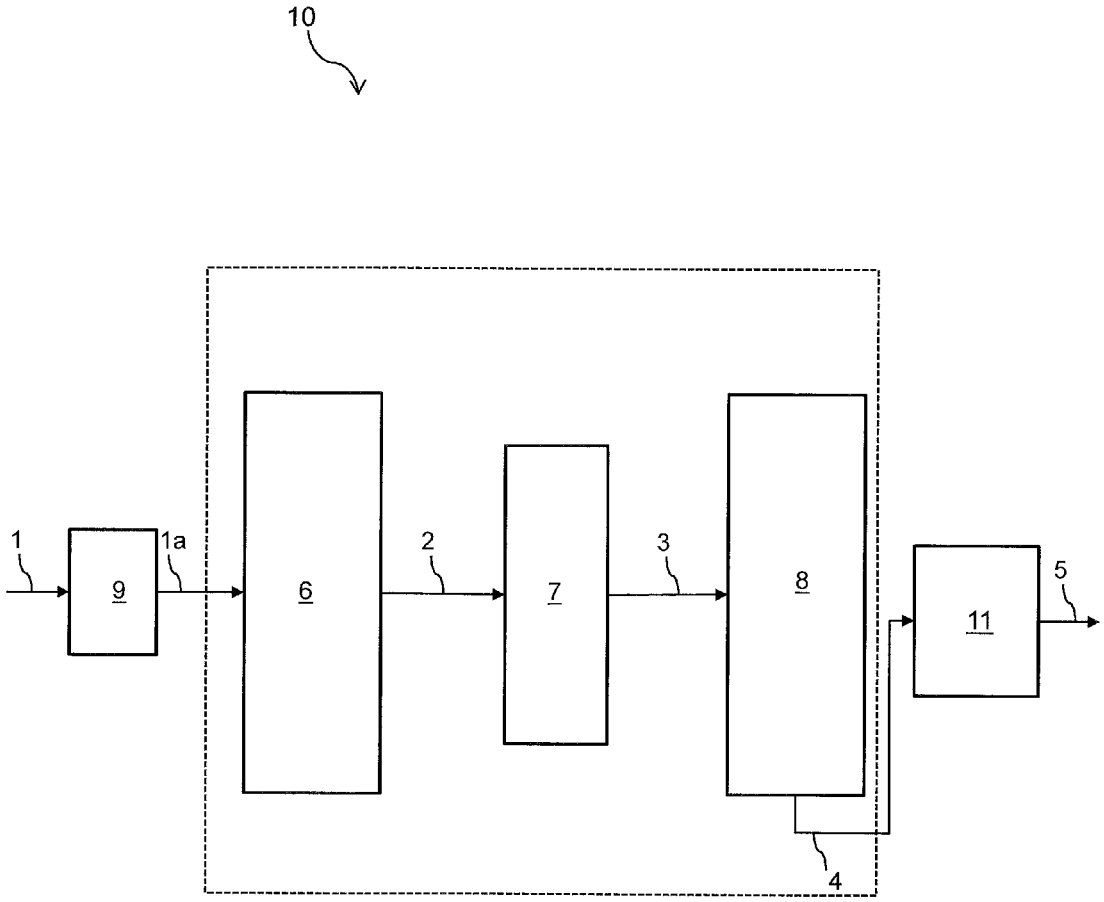
FIG. 3 is an embodiment of a steam cracking process with an integrated vapor liquid separation zone upstream of the convection section of the steam cracking process and integrated vapor-liquid separation within the steam cracking process.

A further embodiment is shown in FIG. 3, where a vapor-liquid separator 9 is included upstream of steam pyrolysis zone 10, through which feed 1 is charged and is fractioned. The vapor phase effluent, stream 1*a*, of separation section 9, is the feed to the steam pyrolysis zone 10. In the convection section 6 the separated effluent is heating to temperatures effective to undergo steam cracking. The heated effluent is charged to the inlet of a vapor-liquid separation device 7 for further separation. The vapor phase effluent of the vapor-liquid separation device 7 is sent to the inlet of steam pyrolysis section 8 where steam is added in effective quantities to crack the feed and produce a mixed product stream.

In the embodiments of FIGS. 1-3, a quenching zone 11 is typically integrated downstream of the steam pyrolysis cracking zone 10 and includes an inlet in fluid communication with the outlet of steam pyrolysis cracking zone 10 for receiving mixed product stream 4. The mixed product is quickly cooled in quenching zone 11 to stop the pyrolysis reaction and a quenched effluent 5 exits.

In certain embodiments, the vapor-liquid separation section 7 includes one or a plurality of vapor liquid separation devices 80 as shown in FIGS. 4A-4C. The vapor liquid separation device 80 is economical to operate and maintenance free since it does not require power or chemical supplies. In general, device 80 comprises three ports including an inlet port 82 for receiving a vapor-liquid mixture, a vapor outlet port 84 and a liquid outlet port 86 for discharging and the collection of the separated vapor and liquid, respectively. Device 80 operates based on a combination of phenomena including conversion of the linear velocity of the incoming mixture into a rotational velocity by the global flow pre-rotational section, a controlled centrifugal effect to pre-separate the vapor from liquid, and a cyclonic effect to promote separation of vapor from the liquid. To attain these effects, device 80 includes a pre-rotational section 88, a controlled cyclonic vertical section 90 and a liquid collector/settling section 92. Device 80 is constructed and arranged with appropriate ratios with a pre-rotational section that is configured and dimensioned to accommodate high influent velocities, for instance, in the range of about 5 meters per second to about 100 meters per second, and short residence times within the device 80, for instance, in the range of about 0.1 seconds to about 10 seconds.

As shown in FIG. 4B, the pre-rotational section 88 includes a controlled pre-rotational element between cross-section (S1) and cross-section (S2), and a connection element to the controlled cyclonic vertical section 90 and located between cross-section (S2) and cross-section (S3). The vapor liquid mixture coming from inlet 82 having a diameter (D1) enters the apparatus tangentially at the cross-section (S1). The area of the entry section (S1) for the incoming flow is at least 10% of the area of the inlet 82 according to the following equation:

$$\pi^*(D1)^2/4 \quad (1)$$

The pre-rotational element 88 defines a curvilinear flow path, and is characterized by constant, decreasing or increasing cross-section from the inlet cross-section S1 to the outlet cross-section S2. The ratio between outlet cross-section from controlled pre-rotational element (S2) and the inlet cross-section (S1) is in certain embodiments in the range of $0.7 \leq S2/S1 \leq 1.4$. Further in certain embodiments the ratio between outlet cross-section from controlled pre-rotational element (S2) and the inlet cross-section (S1) is in certain embodiments in the range of $0.7 \leq S2/S1 \leq 1.05$. These ranges of ratios are particularly effective for handling high velocity influent flows of the vapor/liquid mixture so that the flow through the vapor liquid separation devices occurs within a short residence time. In particular, a ratio between outlet cross-section from controlled pre-rotational element (S2) and the inlet cross-section (S1) of equal to or less than 1 is effective to accelerate the feed flow making it approach linear flow prior to passage to the vertical section 90.

The rotational velocity of the mixture is dependent on the radius of curvature (R1) of the center-line of the pre-rotational element 88 where the center-line is defined as a curvilinear line joining all the center points of successive cross-sectional surfaces of the pre-rotational element 88. In certain embodiments the radius of curvature (R1) is in the range of $2 \leq R1/D1 \leq 6$ with opening angle in the range of $150° \leq \alpha R1 \leq 250°$.

The cross-sectional shape at the inlet section S1, although depicted as generally square, can be a rectangle, a rounded rectangle, a circle, an oval, or other rectilinear, curvilinear or a combination of the aforementioned shapes. In certain embodiments, the shape of the cross-section along the curvilinear path of the pre-rotational element 88 through which the fluid passes progressively changes, for instance, from a generally square shape to a rectangular shape. The progressively changing cross-section of element 88 into a rectangular shape advantageously maximizes the opening area, thus allowing the gas to separate from the liquid mixture at an early stage and to attain a uniform velocity profile and minimize shear stresses in the fluid flow.

The fluid flow from the controlled pre-rotational element 88 from cross-section (S2) passes section (S3) through the connection element to the controlled cyclonic vertical section 90. The connection element includes an opening region that is open and connected to, or integral with, an inlet in the controlled cyclonic vertical section 90. The fluid flow enters the controlled cyclonic vertical section 90 at a high rotational velocity to generate the cyclonic effect. The ratio between connection element outlet cross-section (S3) and inlet cross-section (S2) in certain embodiments is in the range of $2 \leq S3/S1 \leq 5$.

The mixture at a high rotational velocity enters the cyclonic vertical section 90. Kinetic energy is decreased and the vapor separates from the liquid under the cyclonic effect. Cyclones form in the upper level 90*a* and the lower level 90*b* of the cyclonic vertical section 90. In the upper level 90*a*, the mixture is characterized by a high concentration of vapor, while in the lower level 90*b* the mixture is characterized by a high concentration of liquid.

In certain embodiments, the internal diameter D2 of the cyclonic vertical section 90 is within the range of $2 \leq D2/D1 \leq 5$ and can be constant along its height, the length (LU) of the upper portion 90*a* is in the range of $1.2 \leq LU/D2 \leq 3$, and the length (LL) of the lower portion 90*b* is in the range of $2 \leq LL/D2 \leq 5$.

The end of the cyclonic vertical section 90 proximate vapor outlet 84 is connected to a partially open release riser and connected to the pyrolysis section of the steam pyrolysis unit. The diameter (DV) of the partially open release is in certain embodiments in the range of $0.05 \leq DV/D2 \leq 0.4$.

Accordingly, in certain embodiments, and depending on the properties of the incoming mixture, a large volume fraction of the vapor therein exits device 80 from the outlet 84 through the partially open release pipe with a diameter (DV). The liquid phase with a low or non-existent vapor concentration exits through a bottom portion of the cyclonic vertical section 90 having a cross-sectional area S4, and is collected in the liquid collector and settling pipe 92.

Figure 5A:
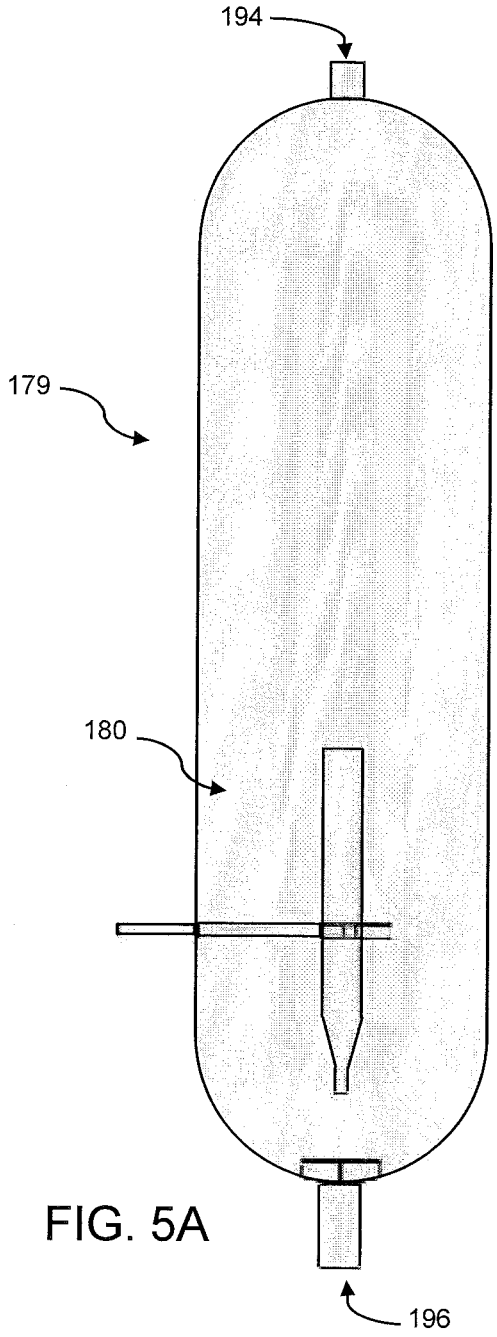
FIGS. 5A-5C are schematic illustrations in section, enlarged section and top section views of a vapor-liquid separation device in a flash vessel used in certain embodiments of a steam cracking unit operation and process described herein.
Figure 5B:
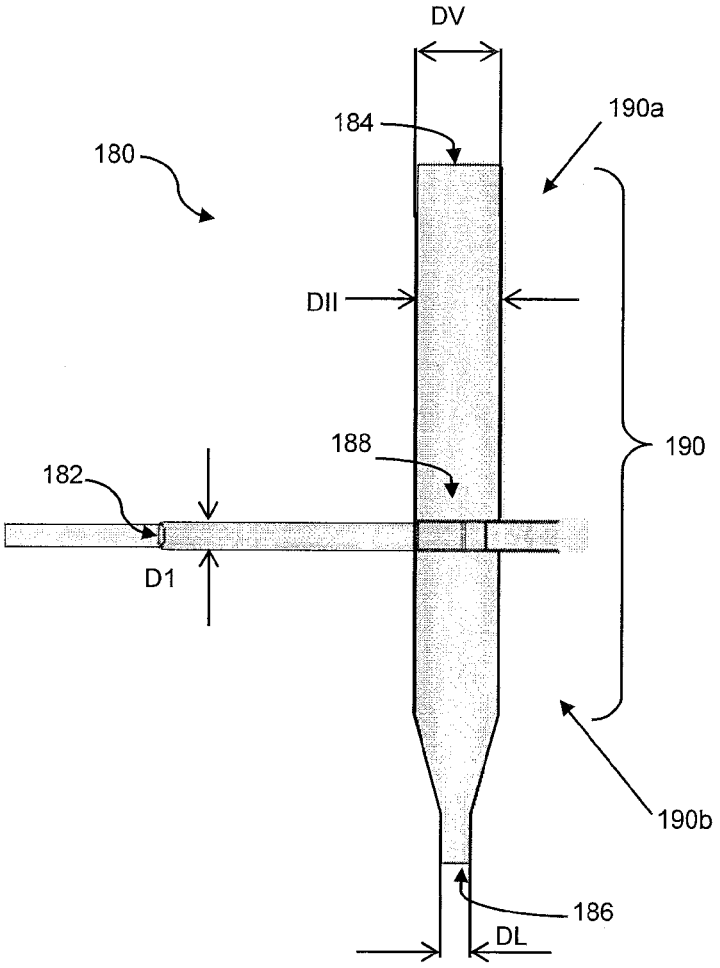
Figure 5C:
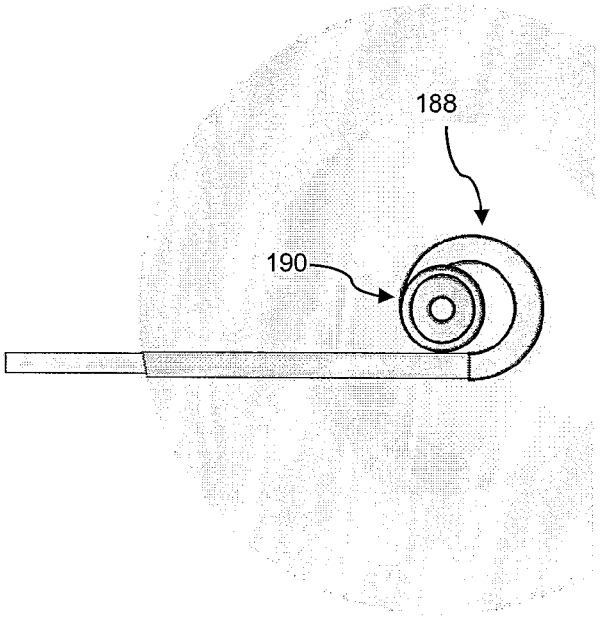

The connection area between the cyclonic vertical section 90 and the liquid collector and settling pipe 92 has an angle in certain embodiment of 90°. In certain embodiments the internal diameter of the liquid collector and settling pipe 92 is in the range of $2 \leq D3/D1 \leq 4$ and is constant across the pipe length, and the length (LH) of the liquid collector and settling pipe 92 is in the range of $1.2 \leq LH/D3 \leq 5$. The liquid with low vapor volume fraction is removed from the apparatus through pipe 86 having a diameter (DL), which in certain embodiments is in the range of $0.05 \leq DL/D3 \leq 0.4$ and located at the bottom or proximate the bottom of the settling pipe. In certain embodiments, a vapor-liquid separation device is provided similar in operation and structure to device 80 without the liquid collector and settling pipe return portion. For instance, a vapor-liquid separation device 180 is used as inlet portion of a flash vessel 179, as shown in FIGS. 5A-5C. In these embodiments the bottom of the vessel 179 serves as a collection and settling zone for the recovered liquid portion from device 180.

In general a vapor phase is discharged through the top 194 of the flash vessel 179 and the liquid phase is recovered from the bottom 196 of the flash vessel 179. The vapor-liquid separation device 180 is economical to operate and maintenance free since it does not require power or chemical supplies. Device 180 comprises three ports including an inlet port 182 for receiving a vapor-liquid mixture, a vapor outlet port 184 for discharging separated vapor and a liquid outlet port 186 for discharging separated liquid. Device 180 operates based on a combination of phenomena including conversion of the linear velocity of the incoming mixture into a rotational velocity by the global flow pre-rotational section, a controlled centrifugal effect to pre-separate the vapor from liquid, and a cyclonic effect to promote separation of vapor from the liquid. To attain these effects, device 180 includes a pre-rotational section 188 and a controlled cyclonic vertical section 190 having an upper portion 190*a* and a lower portion 190*b*. The vapor portion having low liquid volume fraction is discharged through the vapor outlet port 184 having a diameter (DV). Upper portion 190*a* which is partially or totally open and has an internal diameter (DII) in certain embodiments in the range of $0.5 < DV/DII < 1.3$. The liquid portion with low vapor volume fraction is discharged from liquid port 186 having an internal diameter (DL) in certain embodiments in the range of $0.1 < DL/DII < 1.1$. The liquid portion is collected and discharged from the bottom of flash vessel 179.

In order to enhance and to control phase separation, heating steam can be used in the vapor-liquid separation device 80 or 180, particularly when used as a standalone apparatus or is integrated within the inlet of a flash vessel.

While the various members of the vapor-liquid separation devices are described separately and with separate portions, it will be understood by one of ordinary skill in the art that apparatus 80 or apparatus 180 can be formed as a monolithic structure, e.g., it can be cast or molded, or it can be assembled from separate parts, e.g., by welding or otherwise attaching separate components together which may or may not correspond precisely to the members and portions described herein.

The vapor-liquid separation devices described herein can be designed to accommodate a certain flow rate and composition to achieve desired separation, e.g., at 540° C. In one example, for a total flow rate of 2002 $m^3$/day at 540° C. and 2.6 bar, and a flow composition at the inlet of 7% liquid, 38% vapor and 55% steam with a density of 729.5 kg/$m^3$, 7.62 kg/ $m^3$ and 0.6941 kg/$m^3$, respectively, suitable dimensions for device 80 (in the absence of a flash vessel) includes D1=5.25 cm; S1=37.2 $cm^2$; S1=S2=37.2 $cm^2$; S3=100 $cm^2$; $\alpha$R1=213°; R1=14.5 cm; D2=20.3 cm; LU=27 cm; LL=38 cm; LH=34 cm; DL=5.25 cm; DV=1.6 cm; and D3=20.3 cm. For the same flow rate and characteristics, a device 180 used in a flash vessel includes D1=5.25 cm; DV=20.3 cm; DL=6 cm; and DII=20.3 cm.

It will be appreciated that although various dimensions are set forth as diameters, these values can also be equivalent effective diameters in embodiments in which the components parts are not cylindrical.

The feedstock can be any feed conventionally used in feedstock to a steam cracking unit. In certain additional embodiments herein, a range of additional feeds can be charged to the steam cracking unit due to the advantageous effects of the vapor-liquid separation device(s) described herein.

Residuals from the upstream and/or intermediate separator in the steam cracking process described herein can be further processed in a secondary operation, for instance a conventional unit operation including but not limited to solvent deasphalting, slurry hydroprocessing, Fluid Catalytic Cracking (FCC), coker processing, or a combination comprising one or more of the foregoing. One or more product or residual streams from these secondary operations can be recycled as complementary steam cracking feed and/or further upstream of the steam cracking unit described herein.

The use of the vapor-liquid separator either between the convection and pyrolysis sections, or upstream of the convection section, provides an economical and effective means to separate the intermediate product or feed to enhance certain steam cracking operations. The vapor-liquid separation device is maintenance free since it does not have moving parts, or require power or chemical supplies.

The method and system of the present invention have been described above and in the attached drawings; however, modifications will be apparent to those of ordinary skill in the art and the scope of protection for the invention is to be defined by the claims that follow.

The invention claimed is:

1. A steam pyrolysis process comprising:

providing a steam pyrolysis unit including a convection section upstream of a pyrolysis section;

charging a feed to a flash vessel for separation into a light fraction as a steam pyrolysis feed and a heavy fraction, the flash vessel having a vapor-liquid separation device at its inlet, the vapor-liquid separation device including a pre-rotational element for conversion of linear velocity of the incoming feed into a rotational velocity, the pre-rotational element having an entry portion having an inlet for receiving the feed and a curvilinear conduit spanning from the inlet to an outlet, and a transition portion at the outlet of the curvilinear conduit, a controlled cyclonic section having an inlet adjoined to the transition portion of the pre-rotational element through convergence of the curvilinear conduit and the cyclonic section, and a riser section at an upper end of the cyclonic member through which the light fraction passes, wherein a bottom portion of the flash vessel serves as a collection and settling zone for the heavy fraction prior to passage of all or a portion of said heavy fraction;

passing the light fraction to the convection section of the steam pyrolysis unit for heating; and passing the heated light fraction to the pyrolysis section for thermal cracking to produce a mixed product stream.

2. A steam pyrolysis system comprising:

a steam pyrolysis unit including a convection section upstream of a pyrolysis section; and a flash vessel upstream of the convection section of the steam pyrolysis unit, the flash vessel including a vapor-liquid separation device at its inlet, the vapor-liquid separation device including a pre-rotational element for conversion of linear velocity of an incoming feed into a rotational velocity, the pre-rotational element having an entry portion having an inlet for receiving the feed and a curvilinear conduit spanning from the inlet to an outlet, and a transition portion at the outlet of the curvilinear conduit, a controlled cyclonic section having an inlet adjoined to the transition portion of the pre-rotational element through convergence of the curvilinear conduit and the cyclonic section, and a riser section at an upper end of the cyclonic member through which a light fraction passes, wherein a bottom portion of the flash vessel serves as a collection and settling zone for a heavy fraction prior to passage of all or a portion of said heavy fraction.

3. A steam pyrolysis process comprising:

a. charging a feed to a flash vessel for separation into a light fraction as a steam pyrolysis feed and a heavy fraction, the flash vessel having a vapor-liquid separation device at its inlet, the vapor-liquid separation device including a pre-rotational element having an entry portion having an inlet for receiving the feed and a curvilinear conduit spanning from the inlet to an outlet, and a transition portion at the outlet of the curvilinear conduit, a controlled cyclonic section having an inlet adjoined to the transition portion of the pre-rotational element through convergence of the curvilinear conduit and the cyclonic section, and a riser section at an upper end of the cyclonic member through which the light fraction passes, wherein a bottom portion of the flash vessel serves as a collection and settling zone for the heavy fraction prior to passage of all or a portion of said heavy fraction;

b. charging the light fraction to a convection section of a steam pyrolysis unit to produce a heated light fraction;

c. separating the heated light fraction in a vapor-liquid separator into a vapor phase and a liquid phase, the vapor-liquid separator including a pre-rotational element having an entry portion having an inlet for receiving the heated light fraction and a curvilinear conduit spanning from the inlet to an outlet, and a transition portion at the outlet of the curvilinear conduit, a controlled cyclonic section having an inlet adjoined to the transition portion of the pre-rotational element through convergence of the curvilinear conduit and the cyclonic section, and a riser section at an upper end of the cyclonic member through which the vapor phase passes, and a liquid collector/settling section through which liquid phase passes, and d. thermally cracking the vapor phase in a pyrolysis section of a steam pyrolysis unit to produce a mixed product stream.

4. The process as in claim 1, wherein a diameter of a conduit flowing to the inlet has a value D1, the pre-rotational element comprises the inlet having a cross section area S1 for receiving the flowing mixture and the outlet having a cross section area S2, wherein the ratio between S2 and S1 is $0.7 \leq S2/S1 \leq 1.4$, and the curvilinear conduit having a radius of curvature R1 in the range of $2 \leq R1/D1 \leq 6$ and opening angle $\alpha R1$ between S1 and S2 that is in the range of $150° \leq \alpha R1 \leq 250°$.

5. The process as in claim 3, wherein a diameter of a conduit flowing to the inlet has a value D1, the pre-rotational element of the vapor-liquid separation device, the vapor-liquid separator or both the vapor-liquid separation device and the vapor-liquid separator comprises the inlet having a cross section area S1 for receiving the flowing mixture and the outlet having a cross section area S2, wherein the ratio between S2 and S1 is $0.7 \leq S2/S1 \leq 1.4$, and the curvilinear conduit having a radius of curvature R1 in the range of $2 \leq R1/D1 \leq 6$ and opening angle $\alpha R1$ between S1 and S2 that is in the range of $150° \leq \alpha R1 \leq 250°$.

6. The system as in claim 2, wherein a diameter of a conduit flowing to the inlet has a value D1, the pre-rotational element comprises the inlet having a cross section area S1 for receiving the flowing mixture and the outlet having a cross section area S2, wherein the ratio between S2 and S1 is $0.7 \leq S2/S1 \leq 1.4$, and the curvilinear conduit having a radius of curvature R1 in the range of $2 \leq R1/D1 \leq 6$ and opening angle $\alpha R1$ between S1 and S2 that is in the range of $150° \leq \alpha R1 \leq 250°$.

* * * * *